United States Patent [19]

Metz

[11] Patent Number: 4,462,547

[45] Date of Patent: Jul. 31, 1984

[54] METHOD OF APPLYING MARKING LINES TO A ROAD SURFACE

[75] Inventor: Mac L. Metz, Allensville, Pa.

[73] Assignee: Baltimore Paint & Chemical Co., a division of Dutch Boy, Inc., Baltimore, Md.

[21] Appl. No.: 927,468

[22] Filed: Jul. 24, 1978

Related U.S. Application Data

[62] Division of Ser. No. 844,305, Oct. 21, 1977.

[51] Int. Cl.[3] ..... B05B 1/24; B05B 9/03; E01C 23/16

[52] U.S. Cl. ..... 239/130; 165/146; 239/142; 404/94

[58] Field of Search ..... 239/129, 130, 135, 142, 239/150, 151, 127; 165/DIG. 13, 146; 404/94, 95, 111

[56] References Cited

U.S. PATENT DOCUMENTS

| | | | |
|---|---|---|---|
| 74,165 | 2/1868 | Steinmann | 239/136 X |
| 1,627,265 | 5/1927 | Bancel | 165/146 |
| 3,057,273 | 10/1962 | Wilson | 404/94 |
| 3,554,449 | 1/1971 | Currie | 239/130 X |
| 3,820,718 | 6/1974 | Ammon | 239/135 |
| 3,902,666 | 9/1975 | Ito | 239/130 |
| 3,958,724 | 5/1976 | Ordway | 239/127 X |

FOREIGN PATENT DOCUMENTS

| | | | |
|---|---|---|---|
| 450470 | 6/1926 | Fed. Rep. of Germany | 239/598 |
| 808092 | 1/1937 | France | 165/146 |

*Primary Examiner*—James L. Rowland
*Attorney, Agent, or Firm*—A. W. Breiner

[57] ABSTRACT

Apparatus and method of forming a durable and immediately reflective line marking on roadways are described. The method includes melting a thermoplastic resinous material, projecting a continuous stream of the melted material onto the roadway in a line and simultaneously (a) projecting a first continuous stream of glass beads into the stream of thermoplastic material as the stream is being applied to the roadway; and (b) dropping a second stream of glass beads onto the top of the thermoplastic/glass bead line immediately after the line is applied to a roadway. The equipment includes a multisection melting tank for the thermoplastic material having a temperature gradient across the different sections, a heated holding tank separably connected to the melting tank, a spray unit for spraying the thermoplastic material, and means for simultaneously projecting glass beads into the liquid marking material as it is being applied and for dropping glass beads onto the applied line after it is applied.

11 Claims, 6 Drawing Figures

METHOD OF APPLYING MARKING LINES TO A ROAD SURFACE

This is a division of application Ser. No. 844,305 filed Oct. 21, 1977.

BACKGROUND OF THE INVENTION

This invention relates to a method of, and an apparatus for marking center lines, lane lines, etc., on roadways. More particularly, it is directed to marking road surfaces with a melted thermoplastic material, and preferably a thermoplastic material containing reflective glass beads.

It has become conventional practice to spray a marking material onto a road surface to mark traffic center lines, lane lines, etc. The marking material for forming these lines generally is either a rapidly curing paint or a thermoplastic resinous material. Preferably reflective beads are included in the marking materials.

More recently thermoplastic marking materials have gained in importance in marking road surfaces due to the ability to apply a thicker and, therefore, longer lasting line. Although line marking apparatus for applying a thermoplastic material which include means for heating the thermoplastic material to a liquid melt and means for spraying the melted thermoplastic material onto the pavement are known, none is fully satisfactory from the standpoint of temperature control, compactness, and convenience. Moreover, in instances where reflective beads are included in the line, it has been the practice to premix the beads and thermoplastic, and spray the melted premix.

Specifically, U.S. Pat. No. 3,664,242 to Harrington et al, issued May 23, 1972, discloses a method of forming a marking on a roadway in which the roadway is heated to a temperature of about 150° F., to 500° F., and a marking material comprising a continuous stream of solid individual particles of a coloring agent and a resinous material is projected onto the heated area. The individual particles are heated, as they proceed toward the roadway, to a temperature sufficient to soften a major portion of the thermoplastic phase before the particles reach the pavement. U.S. Pat. No. 3,477,352 to Harding et al, issued Nov. 11, 1969, describes a self-propelled apparatus for applying markings to a roadway in which a strip of thermoplastic road marking material is sprayed onto the road surface. Depending upon weather conditions the road surface can be first sprayed with an adhesive material. An additional spray gun sprays a reflective marking material onto the strip of thermoplastic material before it cools and sets. U.S. Pat. No. 3,682,054 to MacPhail et al, issued Aug. 8, 1972, describes an apparatus mounted on a truck for applying a two-component epoxy resin marking composition to a roadway. The truck body is a closed, heat-insulated chamber. Separately heated supply vessels are provided for the resin and the curing agent. A cart, which moves along behind the truck, sprays the two components onto the surface to be marked. U.S. Pat. No. 3,554,449 to Currie, issued Jan. 12, 1971, discloses a portable plastic melter for melting large amounts of thermoplastic material containing glass beads or other aggregate. U.S. Pat. No. 3,286,605 to Wilson et al, issued Nov. 22, 1966, describes an apparatus for marking road surfaces whereby a spray line of marking material is applied to the surface and a stream of glass beads is applied to the spray line while the marking material is still wet. An essential feature of the Wilson et al method is in the size of the glass spheres, whereby the heavier spheres are imbedded in the spray and the lighter spheres become deposited on top of the wet spray line to provide an immediately reflective surface.

OBJECTS OF THE INVENTION

Accordingly, a primary object of the present invention is to provide a new and improved method for applying a reflective marking line to a roadway. P Another object of the present invention is to provide a new and improved method for applying a reflective thermoplastic marking line to a roadway which eliminates the necessity for preparing a premix of glass beads and thermoplastic binder.

Still another object of the present invention is to provide a compact and unitized apparatus for heating and applying a thermoplastic material to a roadway.

It is another object of this invention to provide an apparatus for melting a thermoplastic material wherein the temperature is efficiently controlled.

It is still another object of the present invention to provide an apparatus for applying a thermoplastic material to a roadway including a multisection melter for melting a thermoplastic material wherein the temperature in each of the sections is thermostatically controlled, permitting efficient heat control of the melting of the thermoplastic.

It is another object of the present invention to provide a compact and unitized apparatus for applying a thermoplastic material to a roadway including a multisection melter having temperature control means, a heated holding tank for holding the melted thermoplastic material flowing from the melter, and a spray unit attached to the holding tank for application of the thermoplastic to a surface to be marked.

It is still another object of this invention to provide a system for spraying glass beads having orifice means for projecting the glass beads and second interconnected orifice means for dropping glass beads.

These and other objects of the present invention will be apparent from the following description with particular emphasis being placed on the illustrative drawing.

BRIEF DESCRIPTION OF THE INVENTION

The present invention relates to a method of, and apparatus for forming a durable and immediately reflective marking surface on a roadway by melting a thermoplastic resinous material and projecting a continuous stream of the heated thermoplastic resinous material onto the roadway while simultaneously projecting a continuous stream of glass beads into the stream of thermoplastic before it meets the road surface from one orifice of a glass bead nozzle and dropping a second stream of glass beads onto the top of the thermoplastic/-glass bead line from a second orifice of the nozzle to impart an immediate reflectivity to the marking line.

The apparatus for forming the reflective marking is mounted on a conventional track and includes a jacketed melting tank preferably divided into three sections, each section containing tubes spaced a predetermined distance apart, the uppermost section having the tubes spaced the greatest distance apart than the second section, with the third section having the tubes more closely spaced than the second section. Heated fluid is circulated into and through each of the sections and the temperature in each section of the melting tank is preferably thermostatically controlled by means of electrically actuated valves and bypasses. The effluent from the melting tank is passed through a heated holding tank. The contents of the holding tank are transferred to an applicator unit which applies the melted thermoplastic onto the roadway. Preferably a separate unit projects a continuous stream of glass beads into the stream of thermoplastic material before it reaches the surface to be marked and, at the same time, drops a second stream of glass beads onto the top of the thermoplastic/glass bead line.

DRAWINGS AND DETAILED DESCRIPTION

Figure 1:
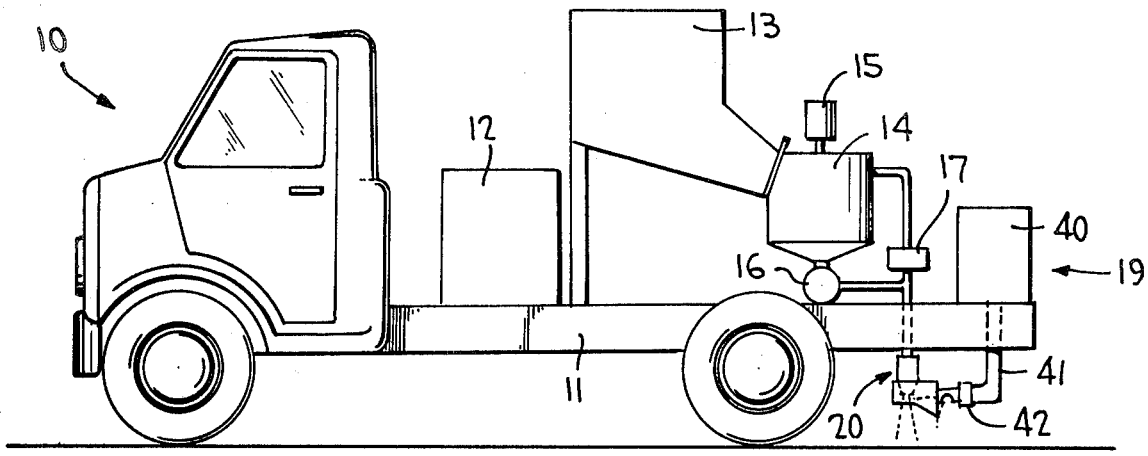
FIG. 1 is a side view of the road marking apparatus mounted on a truck.

Referring to FIG. 1, a motor truck or like vehicle 10 having a loading platform 11 is equipped with a heat source system 12, a melter unit 13, a holding tank unit 14, a thermoplastic spray unit 20, and a glass bead dispenser 19. The melter unit 13 for melting a thermoplastic material is connected through its lower, chutelike end to holding tank unit 14, the latter being equipped with stirrer unit 15. A pump 16, controlled by regulator system 17, supplies thermoplastic material from the holding tank to spray unit 20 for spraying the thermoplastic polymer onto the roadway in a line of predetermined width. Glass bead dispensing unit 19 cooperates with spray unit 20 to provide a marking on a roadway comprising a thermoplastic marking material and reflective beads contained within the line of thermoplastic material and exposed at the top surface to provide immediate reflectivity.

Figures 2, 5:
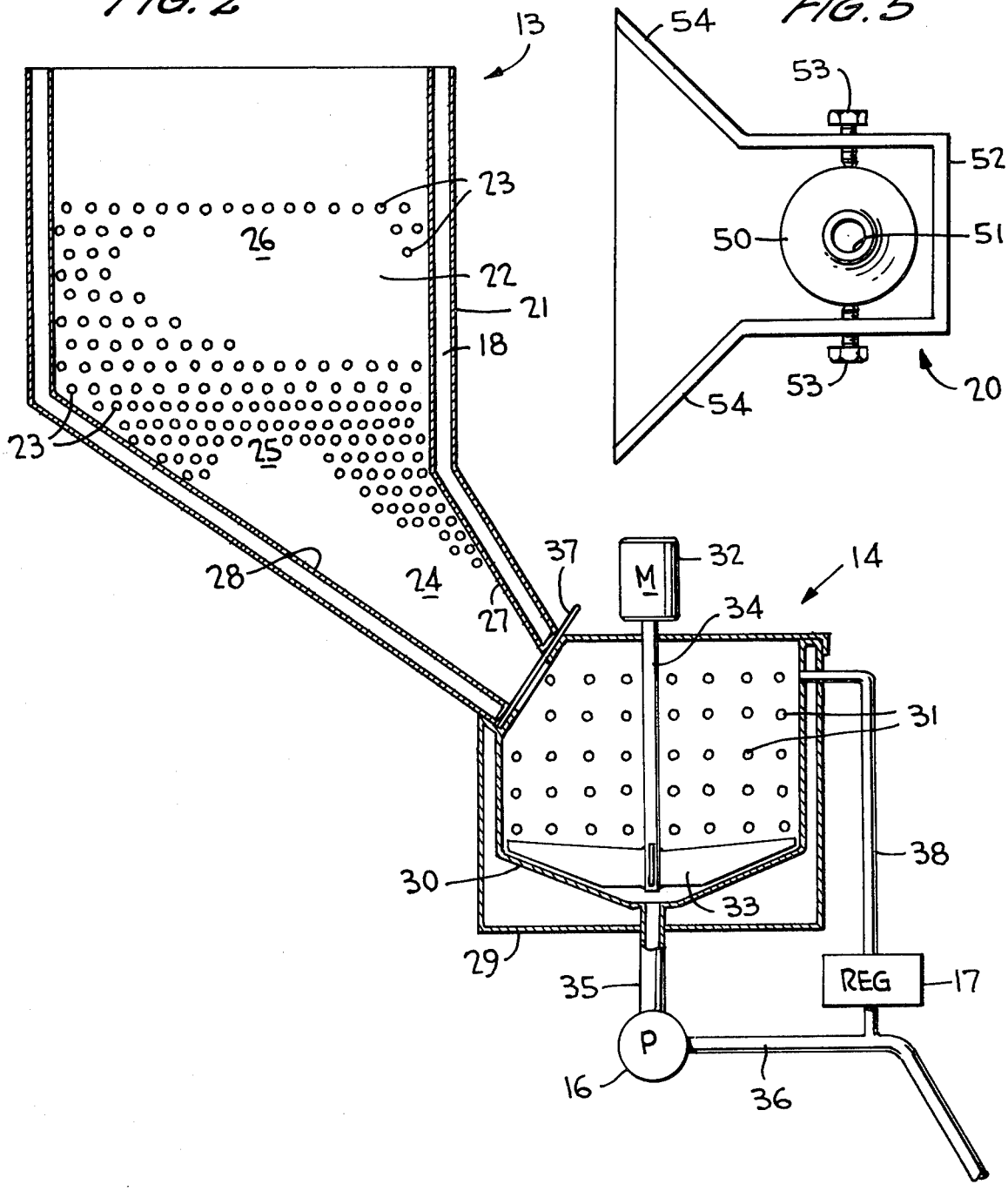
FIG. 2 is a side view, partly in section, of a first embodiment of the melter unit and holding tank system of the apparatus of FIG. 1.
FIG. 5 is a bottom view of a part of the thermoplastic dispensing means taken along the line 5—5 of FIG. 3.

FIG. 2 is a detailed side and partly sectional view of melter unit 13, holding tank unit 14, pump 16, and regulator system 17. Melter unit 13 includes a melting tank 22 having an open top which is divided into three sections 26, 25, and 24, each section being equipped with a series of tubes 23 running in the horizontal direction. In first and uppermost section 26, the tubes are spaced at intervals of ½ inch between each tube in both the horizontal and vertical directions. In second and intermediate section 25, tubes 23 are spaced ⅜ inch apart on both the horizontal and vertical levels. In third and lowermost section 24, tubes 23 are spaced ¼ inch apart in both the vertical and horizontal directions. The tubes in all sections are made up of ⅜ inch inside diameter pipe. The tubes are welded into the side wall of melting tank 22, and the complete unit is enclosed in a jacket 21 with a fluid flow space 18 between the jacket and side wall of tank 22. Heating fluid from heat source 12 is fed to fluid flow space 18 and forced through tubes 23 with a pump, not shown in FIG. 1, but shown in FIG. 6, having an in-line connection to heat source 12.

After a first vertical drop, the side walls of the melter 22 are slanted inward in the direction of the holding tank unit 14 at 27 and 28 to provide a hopper or chute arrangement. Melter unit 13 is separably connected to holding tank unit 14 by movable gate means 37 positioned at the end of the slanted walls 27 and 28 which can be opened as necessary to supply molten thermoplastic material to the holding tank.

Holding tank unit 14 includes a metal shell 29 enclosing a tank 30 equipped with a series of horizontal pipes 31 through which a heating fluid is circulated from the same heating source circulated in the melter unit. The holding tank is equipped with stirrer 15 having stirrer motor 32 which actuates stirring member 33 through shaft 34 to maintain the thermoplastic material in a homogeneous condition.

Thermoplastic effluent from the holding tank 30 is transferred through pipe 35, through a heat-jacketed pressure pump 16 and pipe 36 to spray unit 20. Pump 16 is equipped with a back pressure regulator 17 which maintains the in-line pressure of the thermoplastic material at spray nozzle 20 at a preset pressure reading. Should the preset pressure be exceeded, a portion of the material in the line is moved through pipe 38 into the holding tank 30. Pump 16 and pipe 35 connecting tank 30 with thermoplastic paint dispensing device 20 (FIG. 1) are heated with heating fluid from the same heat source used to heat holding tank 30.

Figure 3:
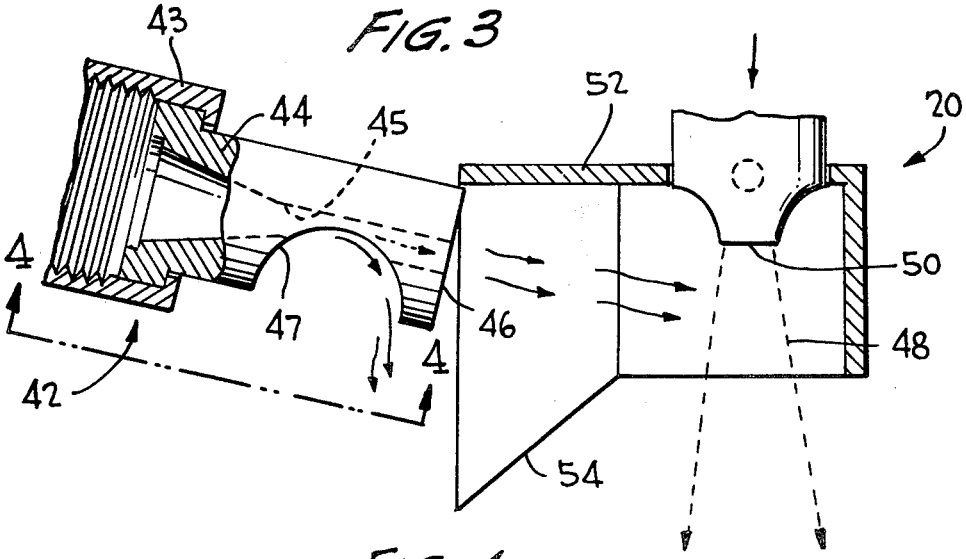
FIG. 3 is a side view of the thermoplastic material and glass bead dispensing system.

FIG. 3 is a detailed cross-sectional view of a part of the glass bead dispensing device 19 shown in cooperation with a part of the thermoplastic dispensing device 20. Glass beads are dispensed from a storage tank 40 through the supply line 41 into the glass bead dispensing nozzle 42 (FIG. 1). The nozzle includes a collar member 43 threadably connected to the supply line 41 and containing a dispensing orifice means 44 threadably inserted therein. The glass beads are forced under pressure through the supply line 41 and bore 45 of orifice means 44. The major portion of the beads from orifice means 44 is sprayed into the thermoplastic material stream 48 through end 46 of bore 45. However, a portion of the glass beads drops directly from bore 45 through the cutaway opening at 47 onto the applied roadway marking line while the line is still wet, to immediately provide a reflective surface to the marking line.

Figure 4:
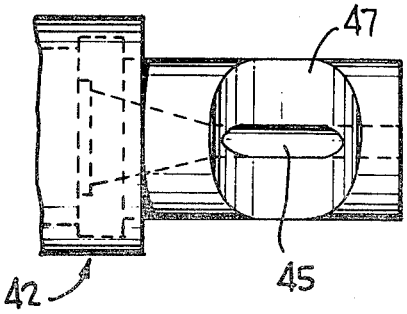
FIG. 4 is a bottom view of a part of the glass bead dispensing nozzle taken along the line 4—4 of FIG. 3.

FIG. 4 is a view from the bottom taken along the line 4—4 of FIG. 3 and discloses the details of the glass bead dispensing nozzle 42 and particularly dispensing orifice cutaway 47 from which the glass beads drop directly onto the marking material after application to the roadway.

As seen in FIGS. 1, 3, and 5, thermoplastic dispensing device 20 includes a nozzle 50 having orifice 51 adjustable to spray a line of thermoplastic material of a predetermined width. Shroud 52 is positioned on nozzle 50 with set screws 53. The shroud has wing extensions 54 which, as most clearly shown in FIGS. 3 and 5, controls the spray pattern of the thermoplastic material and also functions to guide the glass beads projected into the thermoplastic spray pattern.

In operation of the hereinbefore described apparatus, a thermoplastic material in granular form is fed to melter tank 22. The thermoplastic material is gradually heated as it passes through zones 26, 25, and 24 of melter tank 22 (FIG. 2). The top section 26, the middle section 25, and the lower section 24 are heated to and maintained at different temperatures due to the varied spacing of tubes 23 by circulation of a common heating fluid through fluid flow space 18 and tubes 23. The thermoplastic is gradually melted by being first heated to its softening temperature in the first section, as it passes into the second section it becomes more fluid, and finally in the third section the thermoplastic material acquires a fluidity sufficient for spraying.

Figure 6:
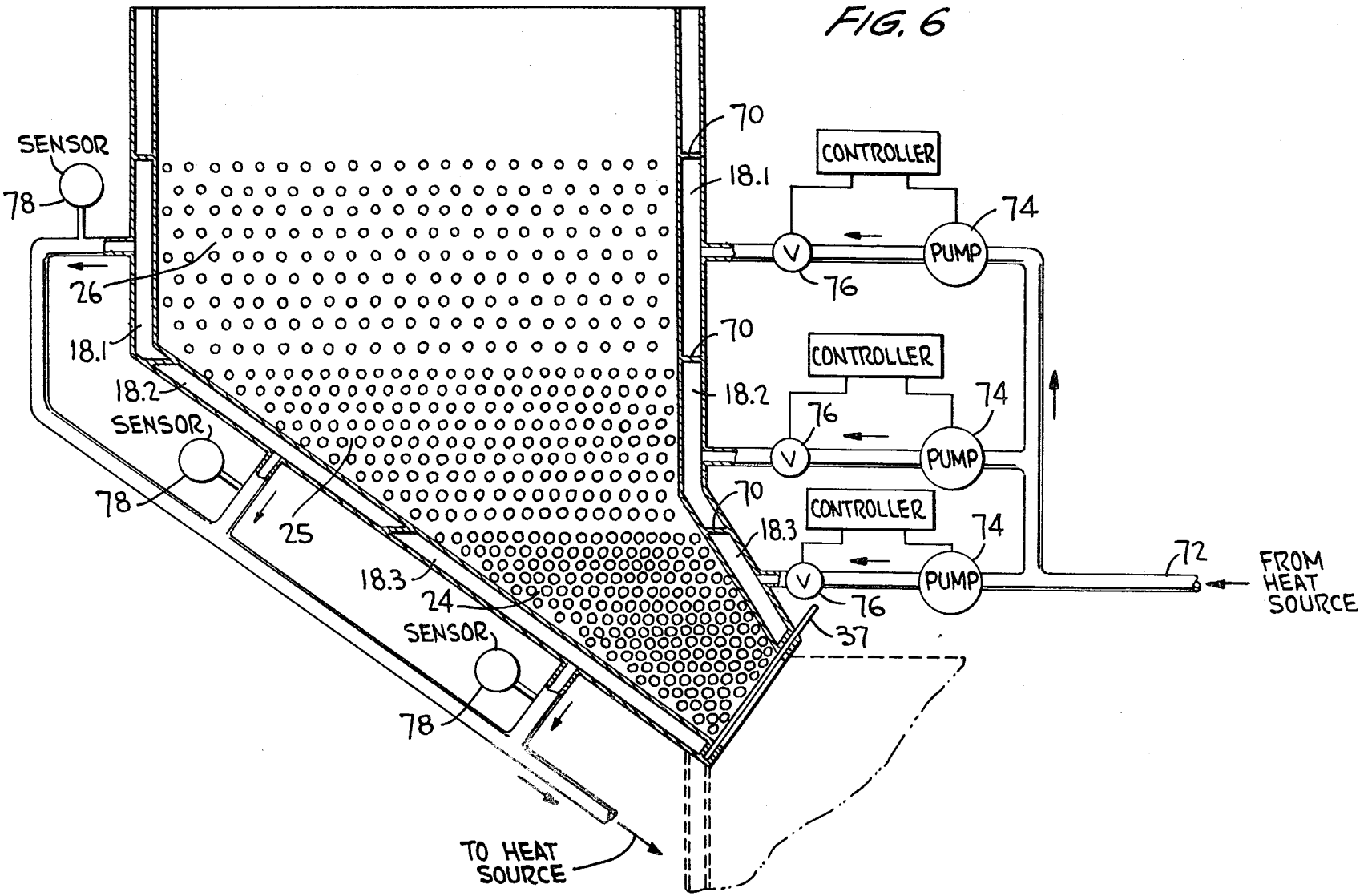
FIG. 6 is a side view of a melter unit including temperature control means for each section.

While the melter unit of FIG. 2 will provide efficient temperature control because of the different spacing of tubes 23 in each of sections 26, 25, and 24, if it is desired to have greater temperature control the melter unit can be modified as shown in FIG. 6. In the melter unit of FIG. 6 partitions 70 are located in fluid passage 18 between the three sections 26, 25, and 24 to provide three separate passages 18.1, 18.2, and 18.3. Heating fluid, for example a viscous oil, is pumped from the heat source 12, not shown in FIG. 6, through conduit 72. Conduit 72 serves three pumps 74 which supply fluid to sections 26, 25, and 24. The fluid temperature of each section is individually controlled by a combination of pumps 74, valves 76, and sensors 78. More specifically, sensor 78 will be set at a predetermined temperature. When the temperature registered by the sensor 78 is at or below the desired temperature, valve 76 and pump 74 will automatically provide a greater amount or lesser amount of fluid to maintain the desired, substantially uniform temperature within the section.

Once the thermoplastic material reaches a desired and predetermined temperature, gate 37 is opened and the heated thermoplastic material is allowed to flow into the holding tank 30 where it is stirred by the blades 33 of the stirrer actuated through shaft 34 from motor 32. The holding tank is maintained at substantially the same temperature as third zone 24 of melter unit 13 by passing heating fluid through the tubes 31. The holding tank has a separate fluid heating control, not shown, to hold the thermoplastic material at plus or minus 5 degrees of a predetermined temperature.

From the holding tank the thermoplastic is moved through conduit or pipe 35 by jacketed pump 16 which is maintained at the same temperature as the holding tank. The pump transfers the thermoplastic material through pipe 36 to the nozzle 50 of dispensing unit 20. A back pressure regulator 17 maintains the in-line pressure of the material at a preset pressure reading. Should the in-line pressure increase, the regulator will transfer a portion of the thermoplastic material through tube 38 into the holding tank 30. The thermoplastic material moves from the pipe 36 into the nozzle 50 for application to the road surface. Glass beads are projected from end 46 of bore 45 of nozzle 42 into path 48 of thermoplastic material as it is being applied to the road surface. At the same time additional glass beads are dropped onto the wet line through cutaway section 47. The beads from opening 47 remain on the top of the marking line to provide a line which is immediately reflective.

As will be apparent, the temperature of the system including the temperature of the various individual sections of melting tank 22 and the holding tank can be varied depending upon the thermoplastic material used. Presently the most commonly used thermoplastic for road markings is polyethylene. In the event polyethylene is used, a heating oil is supplied to heat source 12 and brought to a top temperature of approximately 375° to 400° F. The heating oil at the top temperature is fed by the pumps 74 into the three sections of melting tank 22. By heat loss of the heating fluid in cooperation with valve and sensor means 76 and 78, respectively, the temperature in the various sections can be adjusted. Preferably the temperature in unit 26 will be maintained at about 375°-400° F. The temperature in unit 25 will preferably be maintained in the neighborhood of 350°-375° F., whereas the temperature in the third section 24 will be in the neighborhood of 300°-350° F. The holding tank 30 will be maintained at substantially the same temperature as the third section of the melting tank. As will be apparent, however, depending upon conditions and materials, variation may be desired.

The apparatus and method of the present invention have substantial and numerous advantages over the apparatus and methods of the prior art. Inasmuch as the thermoplastic and glass beads are supplied from separate sources, i.e., not as a premix, a substantial savings in cost is realized in that it is not necessary to premix the binder and paint and ship the two materials together. Additionally, greater selectivity with respect to the ratio of beads to thermoplastic material is available at the site of application. Moreover, since the glass beads and thermoplastic are supplied separately, a gear type pump with a back pressure fluid regulator can be employed to pump the thermoplastic resulting in a more compact, self-contained system which will greatly increase the performance of the center line equipment.

An additional advantage is in the compactness of the unit which permits the melter along with the spray system to be mounted on a single truck, eliminating need for an extra truck and the necessity of transfer of the thermoplastic material from a melter truck to a spray truck. The system is also much safer in that there is no need for a large pressure tank with a heated jacket. Instead, a small gear pump with an in-line back pressure regulator powered by a hydraulically driven motor can be used to pressurize the spray system from the holding tank maintained at atmospheric pressure.

Another advantage occurs in the event of equipment breakdown or other emergency requiring shutdown. In the prior art systems the melted thermoplastic had to be transferred to another container, allowed to harden, and re-melted. The only alternative to such transfer was to dump the thermoplastic, thus losing the thermoplastic. With the present system, because of the compartmentalized melter and holding tank maintained at atmospheric pressure and the individual heat control of the various stages of the system, there is no need to drain the liquid from the truck in the event of equipment breakdown or discontinuance of operation for short or extended periods of time including due to weather conditions.

While the preferred embodiment of the system has been described, various modifications can be made within the scope of the aforesaid description. For example, although the method and system have been described in reference to a thermoplastic marking material, it will be apparent that the method of projecting glass beads into the stream of marking material as it is being directed to the surface to be marked, and simultaneously dropping beads onto the marking line after application of the line to the road surface can apply as well to other marking materials including fast-drying paints. The marking applicator and the glass bead dispensing means can be substantially identical irrespective of whether a thermoplastic or fast-drying paint is used as the marking material. These modifications being within the ability of one skilled in the art form part of the present invention and are embraced by the appended claims.

It is claimed:

1. A machine system for forming a marking line of thermoplastic on the surface of a roadway comprising a melter unit for melting a thermoplastic to form a thermoplastic melt including a melting tank having first, second, and third sections, each of said sections having fluid flow tubes horizontally spaced therein, the uppermost of said sections having said tubes spaced a greater distance apart than said second section, and the second section having the tubes spaced a greater distance apart than said third section; and jacket means surrounding said melter tank, said jacket means and the outer wall of said melting tank forming a fluid flow space, said fluid flow space being in fluid communication with said horizontal tubes; a melt holding unit positioned in relation to said melting tank to permit gravitational flow from said melting tank into said melt holding unit; means for separably connecting said melter unit to said melt holding tank including gate means between said melting tank and holding tank for releasing under gravitational flow thermoplastic melt from said melting tank into said holding tank, a melt spray unit and transfer means for transferring said melt from said holding tank to said spray unit for spraying said melt onto the surface of a roadway to form a marking line.

2. The machine system of claim 1 wherein said fluid flow space includes partitions between said first, second, and third sections.

3. The machine system of claim 2 wherein pump, valve, and sensor means are constructed and arranged with each of said first, second, and third sections for independently maintaining and controlling the temperature within said first, second, and third sections.

4. The machine system of claim 1 wherein said holding tank includes an inner and outer tank, said inner tank having a series of horizontal tubes welded therein, said inner and outer tank being constructed and arranged to provide a fluid flow space between said inner and outer tanks, said fluid flow space being in fluid communication with said horizontal tubes to permit circulation of fluid to maintain and control the temperature of said holding tank.

5. The machine system of claim 4 wherein said holding tank includes stirring means for agitating said thermoplastic melt.

6. The machine system of claim 1 wherein said transfer means includes pump means equipped with a back pressure regulator for maintaining the pressure of the melt at said spray unit at a predetermined pressure.

7. The machine system of claim 1 including glass bead dispenser means constructed and arranged with said melt spray unit, said glass bead dispensing means including means for projecting glass beads into the sprayed melt.

8. The machine system of claim 7 wherein the glass bead dispensing means includes means for dropping glass beads onto the top surface of the marking line immediately after formation of said line on said road surface.

9. The machine system of claim 8 wherein said means for dispensing glass beads includes nozzle means having a bore extending therethrough for projecting said glass beads into said sprayed melt and a curved cutaway forward of the outlet of said bore and in communication with said bore for droppping glass beads onto said surface.

10. The machine system of claim 1 in combination with a motor vehicle, said machine system being mounted entirely upon said motor vehicle.

11. The machine system of claim 8 in combination with a motor vehicle, said machine system being mounted entirely upon said motor vehicle.

* * * * *